US008474615B2

(12) United States Patent
Kernodle, Jr.

(10) Patent No.: US 8,474,615 B2
(45) Date of Patent: Jul. 2, 2013

(54) RETENTION DUAL USE BIT HOLDER

(75) Inventor: Richard Vernon Kernodle, Jr., Moncure, NC (US)

(73) Assignee: Richard Vernon Kernodle, Jr., Moncure, NC (US)

( * ) Notice: Subject to any disclaimer, the term of this patent is extended or adjusted under 35 U.S.C. 154(b) by 1112 days.

(21) Appl. No.: 11/954,508

(22) Filed: Dec. 12, 2007

(65) Prior Publication Data

US 2009/0152150 A1 Jun. 18, 2009

(51) Int. Cl.
*B65D 85/28* (2006.01)

(52) U.S. Cl.
USPC ..... 206/379; 206/349; 81/490; 81/177.4

(58) Field of Classification Search
USPC ..... 206/379, 349; 81/490, 177.4
See application file for complete search history.

(56) References Cited

U.S. PATENT DOCUMENTS

| | | | | |
|---|---|---|---|---|
| 2,580,099 | A * | 12/1951 | Jaeger | 335/285 |
| 4,535,658 | A | 8/1985 | Molinari | |
| 4,728,153 | A | 3/1988 | Ojanen et al. | |
| 5,067,775 | A | 11/1991 | D'Angelo | |
| 5,746,279 | A | 5/1998 | Havlinek et al. | |
| 5,774,919 | A * | 7/1998 | Rich | 7/167 |
| 5,916,341 | A * | 6/1999 | Lin | 81/437 |
| 6,272,708 | B1 * | 8/2001 | Chen | 7/105 |
| 6,305,255 | B1 * | 10/2001 | Wu | 81/439 |
| 6,490,955 | B2 * | 12/2002 | Chang-Kao et al. | 81/177.75 |
| 6,739,226 | B2 * | 5/2004 | Beauchamp | 81/490 |
| 6,761,095 | B2 * | 7/2004 | Beauchamp | 81/490 |
| 7,051,629 | B2 * | 5/2006 | Huang | 81/489 |
| 7,073,417 | B2 | 7/2006 | Beauchamp | |
| 2005/0116042 | A1 * | 6/2005 | Willkens | 235/462.44 |

* cited by examiner

*Primary Examiner* — J. Gregory Pickett
*Assistant Examiner* — Blaine Neway
(74) *Attorney, Agent, or Firm* — Clements Bernard PLLC; Seth L. Hudson

(57) ABSTRACT

A bit holder, comprising a base having a plurality of longitudinally oriented bit compartments for releasably storing multiple tool bits, a retention member positioned on the outside of the base for releasably retaining the tool bits within the base, and a magnetic member engaged with the base for allowing the base to be removably attached to a metal surface for storage.

19 Claims, 12 Drawing Sheets

RETENTION DUAL USE BIT HOLDER

FIELD OF THE INVENTION

The present invention relates generally to a bit holder, and more particularly, a bit holder that utilizes a retention member that exerts a tension force upon the bit for releasably retaining the bits within the holder.

BACKGROUND OF THE INVENTION

Bits are tools that may be attached to the end of a power tool, such as a drill, which supplies axial force and rotates the bits. The bits can serve a number of functions such as creating a hole in a surface, acting as the head of a screwdriver that mates with the head of the screw, drive a bolt, socket or the like. These bits are considerably smaller than other such tools, like a drill, nail gun, or power saw, therefore, they can be easily mishandled or misplaced on the job or in storage. In addition, on a construction job a worker could be required to use multiple bits that have to be interchanged to suit the particular construction purpose. It would be advantageous for the construction worker to be able to access the needed bits is an expeditious manner in order to increase the efficiency of the work to stay on schedule, or better yet, ahead of schedule.

Traditionally, bit holders are available on the market for releasably holding the bits within a container, such as the container the bits were purchased. These bit holders are usually bulky, and contain numerous bits, and consist of bits used for a single application.

Therefore, it is desirable to have a device that is adapted to releasably secure the specifically needed bits that can be secured to a metallic surface such as scaffolding or a ladder.

BRIEF SUMMARY OF THE INVENTION

The present invention provides a bit holder, comprising a base having a plurality of longitudinally oriented bit compartments for releasably storing multiple tool bits, and a retention member positioned on the outside of the base for releasably retaining the tool bits within the base.

In an exemplary embodiment of the present invention, the bit holder further comprises a magnetic member engaged with the base for allowing the base to be removably attached to a metal surface for storage.

In another exemplary embodiment of the present invention, the bit holder further comprises a second retaining member position on the outside of the base for securing an attachment member.

In yet another exemplary embodiment of the present invention, the bit holder further comprises spaced-apart longitudinally oriented bit compartments positioned around the top portion of the base.

In yet another exemplary embodiment of the present invention, the bit holder further comprises a hexagonally shaped bit compartment positioned within the center of the base for accepting a correspondingly shaped bit.

In yet another exemplary embodiment of the present invention, the bit holder further comprises a base exterior having an abrasive surface for increasing the coefficient of friction and enabling the bit holder to be easily held by a user.

In yet another exemplary embodiment of the present invention, the bit holder further comprising a clip for removably attaching the bit holder to an object.

In yet another exemplary embodiment of the present invention, the bit holder further comprising an upright for attaching an attachment mechanism thereto.

In yet another exemplary embodiment of the present invention the bit holder, comprising a base having a plurality of longitudinally oriented bit compartments for releasably storing multiple tool bits, a recessed groove positioned on the outside of the base, a retention member positioned within the recessed groove for releasably retaining the tool bits within the base, and a magnetic member engaged with the base for allowing the base to be removably attached to a metal storage surface for storage.

In yet another exemplary embodiment of the present invention, the bit holder comprising a cylindrical base having a top portion and a bottom portion with a plurality of equally spaced-apart, longitudinally oriented bit compartments extending from the top portion and recessed into the base for releasably storing multiple tool bits, a recessed grove positioned on the outside of the base that extends into the longitudinally oriented bit compartments forming an opening therein, a retention member is positioned within the recessed groove that extends into the longitudinally oriented bit compartment for releasably retaining the tool bits within the base, and a magnetic member that is positioned on the bottom portion of the base for allowing the base to be removably attached to a metal storage surface for storage.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

Figure 1:
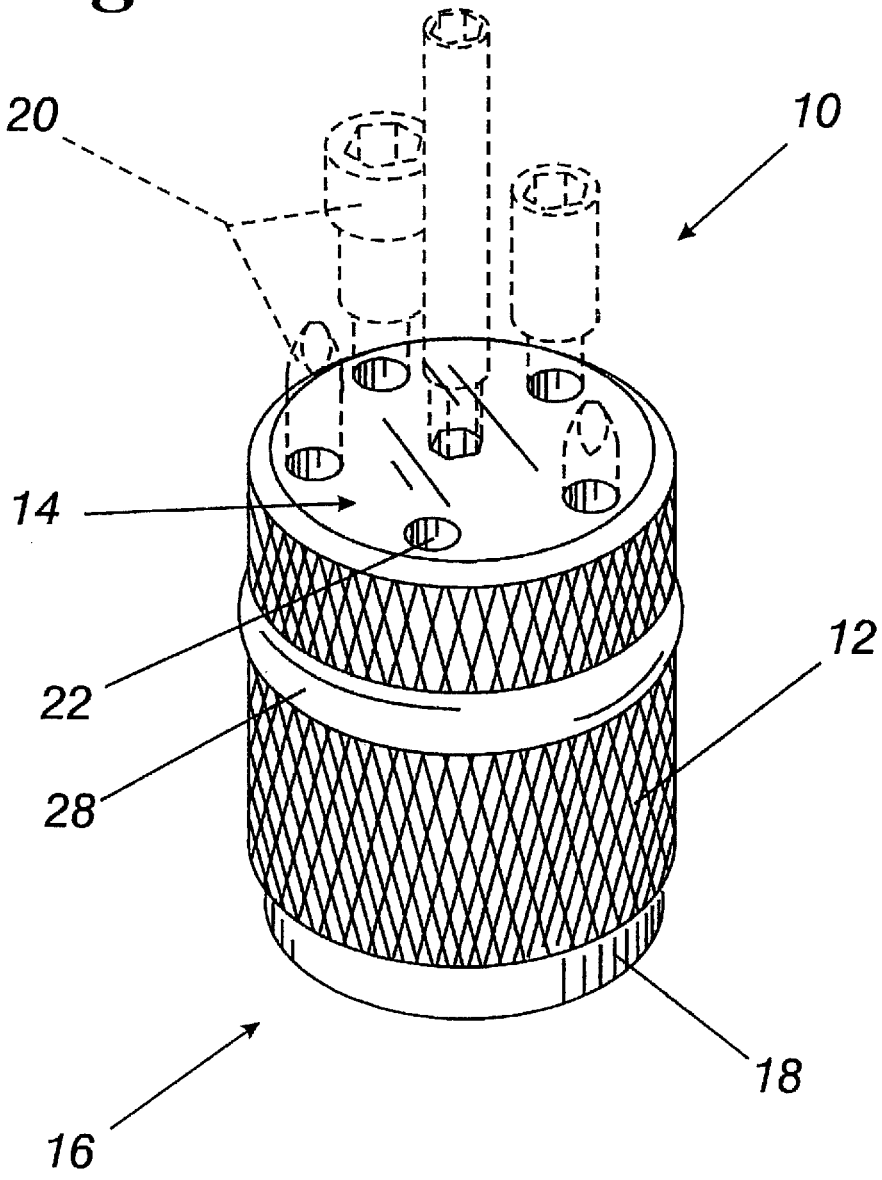
FIG. 1 is a perspective view of the bit holder.

Referring now specifically to the drawings, an exemplary bit holder is illustrated in FIG. 1 and is shown generally at reference numeral 10. As illustrated, the device 10 has a cylindrical base 12 with a top portion 14 and a bottom portion 16. A magnetic member 18 is optionally engaged to the base 12. The magnetic member 18 allows the base 12 to be removably attached to a metallic surface for storage. Bits 20, disposed within longitudinally oriented bit compartments 22, protrude through the top portion 14 of the device 10, allowing the bits 20 to be grasped by a construction professional and removed from the base 12. The base 12 has an outer surface that is abrasive, allowing the user to easily grip the base 12 during use. The surface of the base 12 can be coated, fitted, milled or formed with any material, indentions, covering, or the like that increases coefficient of friction of the surface.

Figure 2:
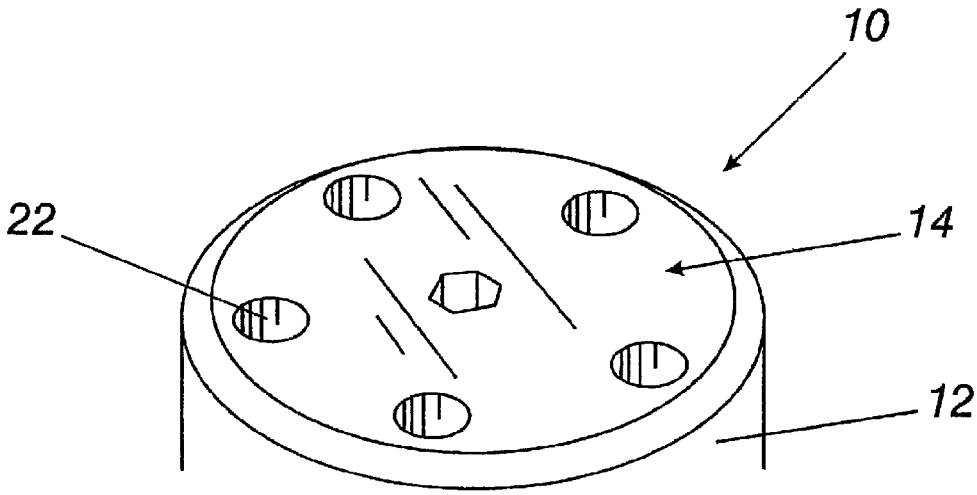
FIG. 2 is a perspective view of the top portion of the bit holder.
Figure 3:
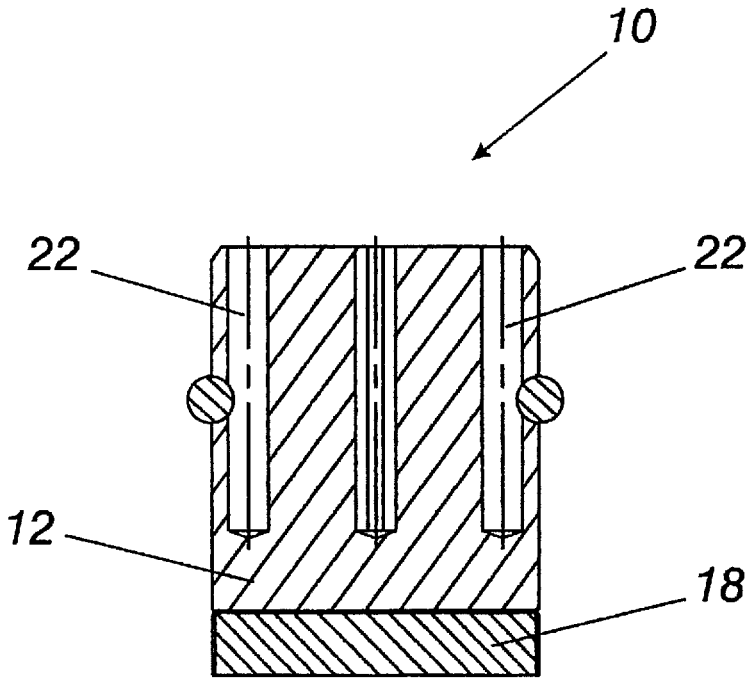
FIG. 3 is a cross-sectional view of the bit holder.

As shown in FIG. 2, the top portion 14 of the base 12 has a plurality of longitudinally oriented bit compartments 22 for releasably storing multiple tool bits 20. The bit compartments 22 can be of any shape and sized diameter, thus allowing the bit compartments 22 to receive a specific bit 20. As shown in FIG. 3, the bit compartments 22 are recessed within the base 12 to securely hold the bits 20 in place until needed by the construction professional. The bit compartments 22 may consist of five compartments, as shown in FIGS. 1-3, equally spaced-apart around the periphery of the top portion 14 of the base 12. A single hexagonally shaped bit compartment 22 may be located with the center of the top portion 14 of the base 12.

Figure 4:
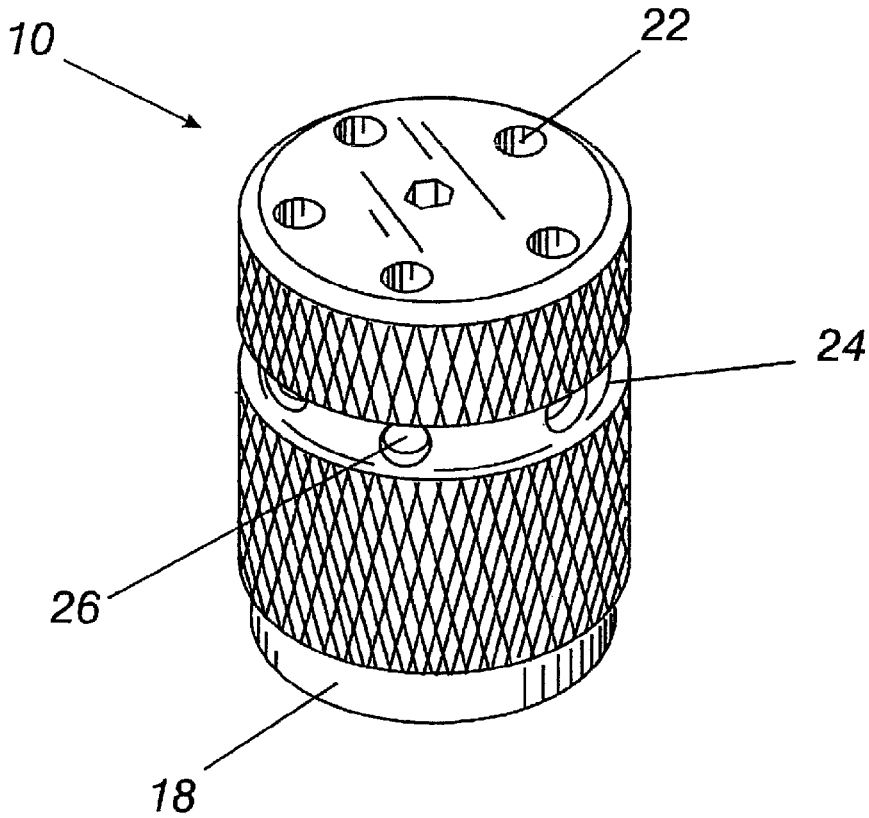
FIG. 4 is a perspective view of the bit holder.
Figure 5:
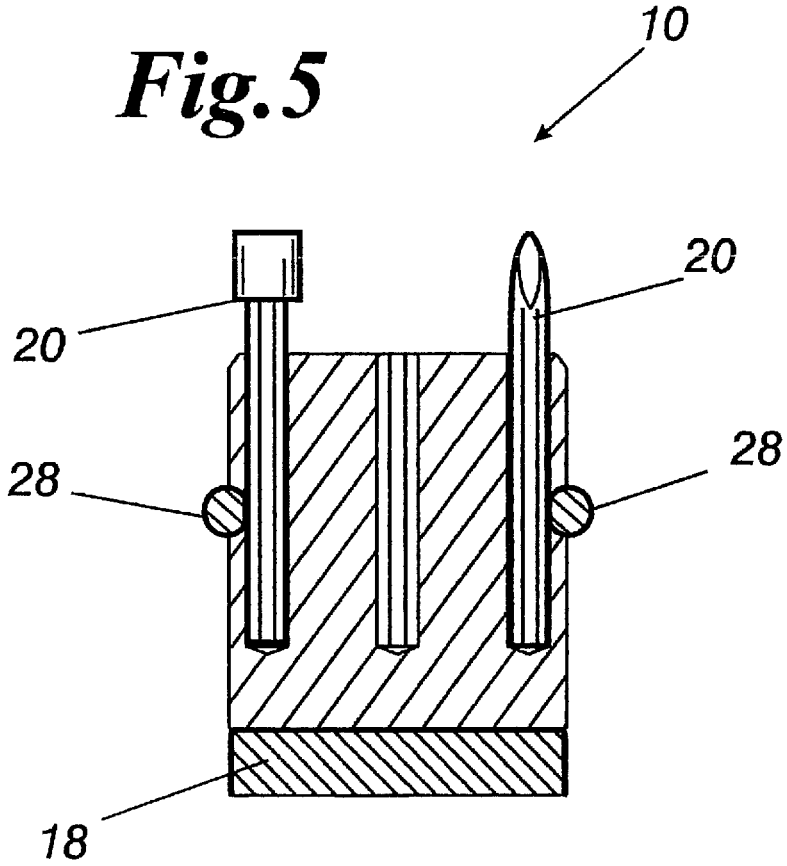
FIG. 5 is a cross-sectional view of the bit holder with bits located within the internal compartments.

As shown in FIG. 4, a recessed groove 24 circumvents the exterior of the base 12. The inner portion of the groove 24 intersects the bit compartments 22, forming a bore 26 therebetween. As illustrated in FIG. 5, when the bits 20 are inserted into the bit compartments 22, an outer portion of the bit 20 protrudes into the groove 24 through the bore 26. The retention member 28 that is positioned within the groove provides a tension force upon the bit 20, retaining the bit 20 within the bit compartment 22 until it is removed by a construction professional. In addition to the tension force exerted by the retention member 28, the magnetic member 18 exerts a magnetic force that may be used to also retain the bits 20 within the bit compartments 22. In another alternative, a wholly separate magnet may be inserted into the center bit compartment 22 for retaining the bit therein.

Figure 6:
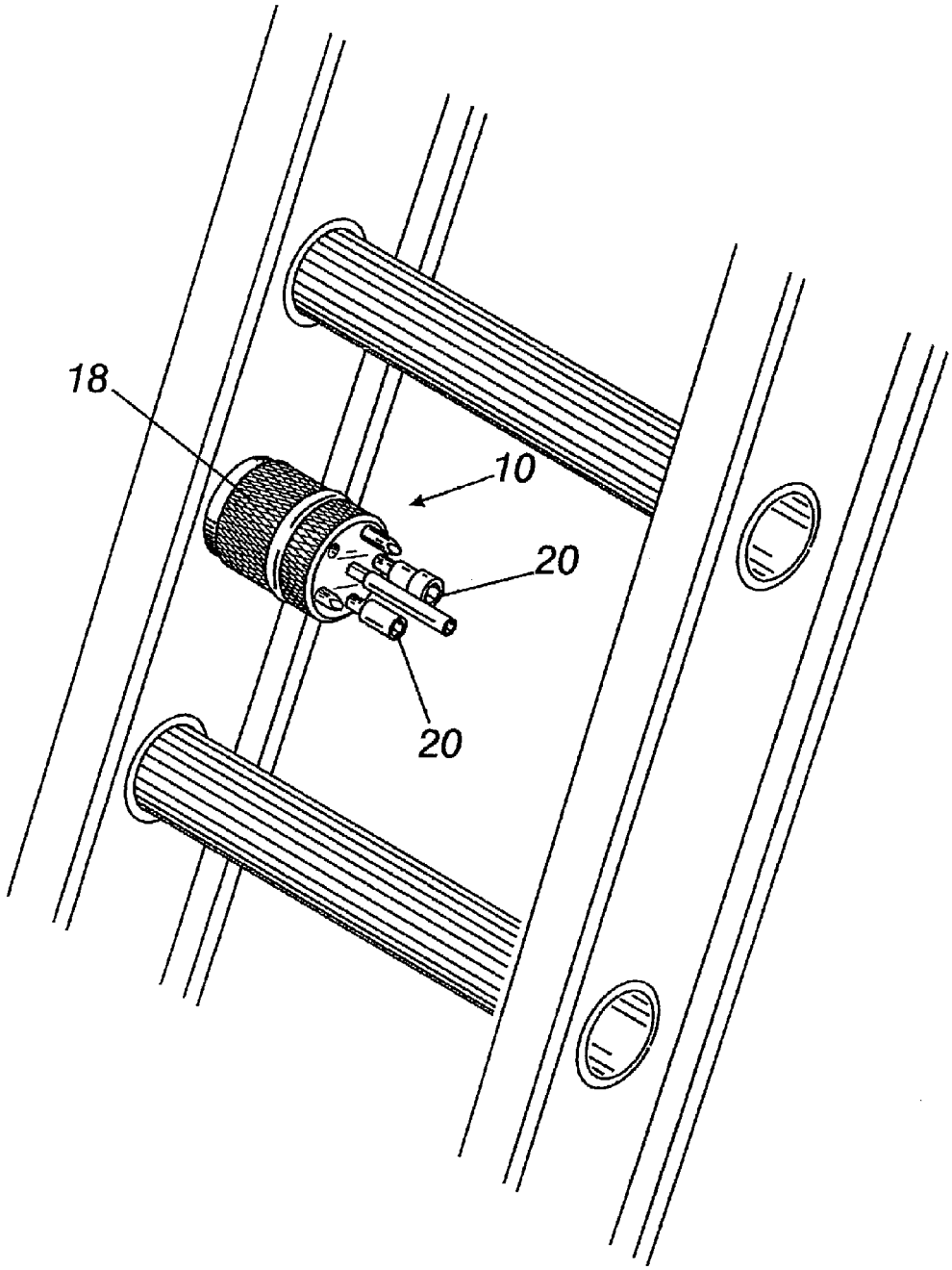
FIG. 6 is a view of the bit holder in a storage arrangement upon a ladder.

The bit holder 10 may be releasably attached to a metallic structure by the magnetic member 18 for the convenience of the construction professional. In it most common usage, the bit holder 10 would be releasably attached to a steel ladder or scaffolding, relying upon the magnetic attraction between the magnetic member 18 and the corresponding metallic surface. The magnetic member 18 would allow the construction professional to position the bit holder 10 almost anywhere on a ladder or scaffolding to retain the bits 20 within arm's length of the construction professional, as illustrated in FIG. 6.

Figure 7:
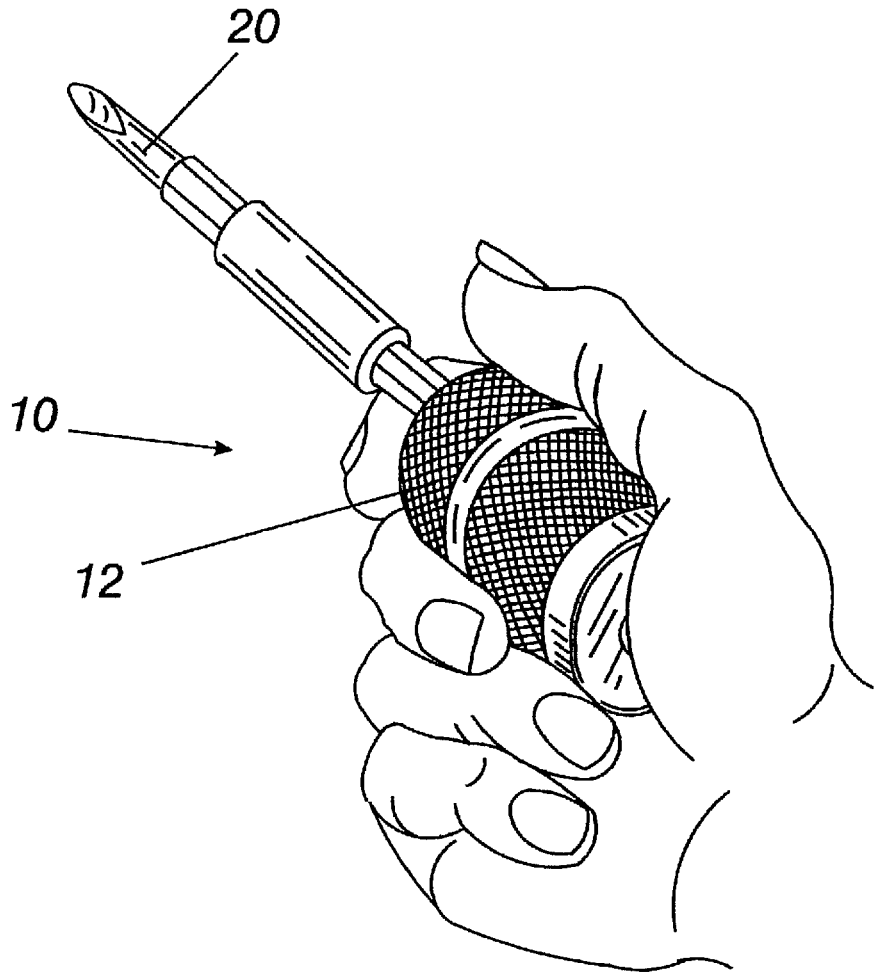
FIG. 7 is a perspective view of the bit holder in use as a screw driver.

In another alternative, the bit holder 10 could serve the dual purpose of a bit holder and screw driver. In this application, a bit 20 is placed within one of the bit compartments 22, wherein the base 12 is utilized as a handle, allowing the construction professional to rotate the base 12, as shown in FIG. 7, thus rotating the bit 20. This embodiment would allow a construction professional to simply use the bit holder 10, which is relatively small and lightweight as a screw driver, without having to carry a separate tool up and down scaffolding and ladders, or extracting these items from a tool box.

Figure 8:
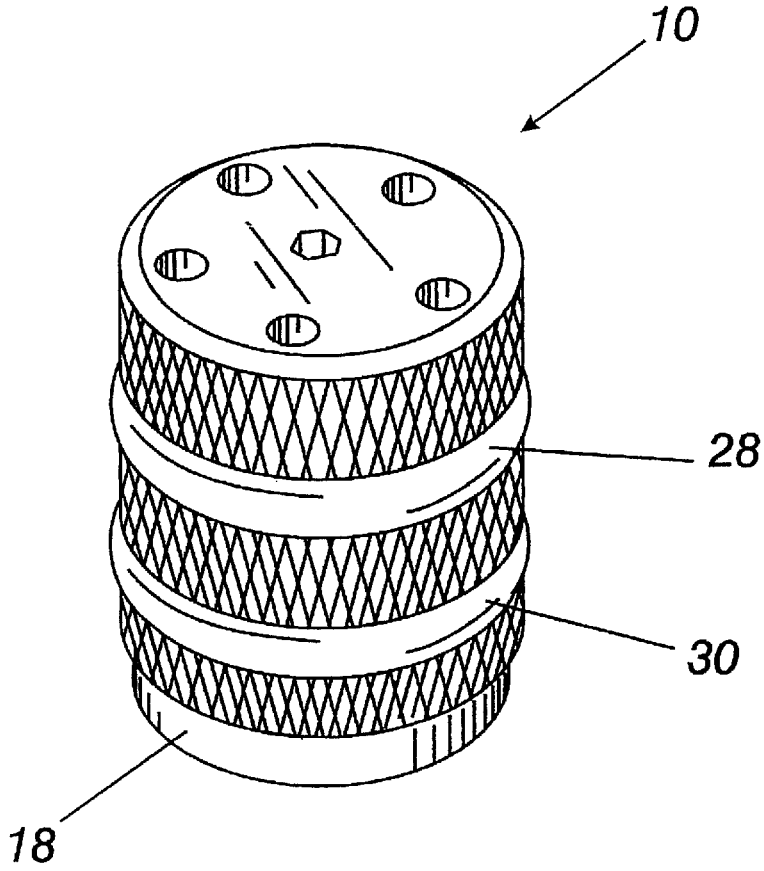
FIG. 8 is a perspective view of the bit holder with a second retention member.
Figure 9:
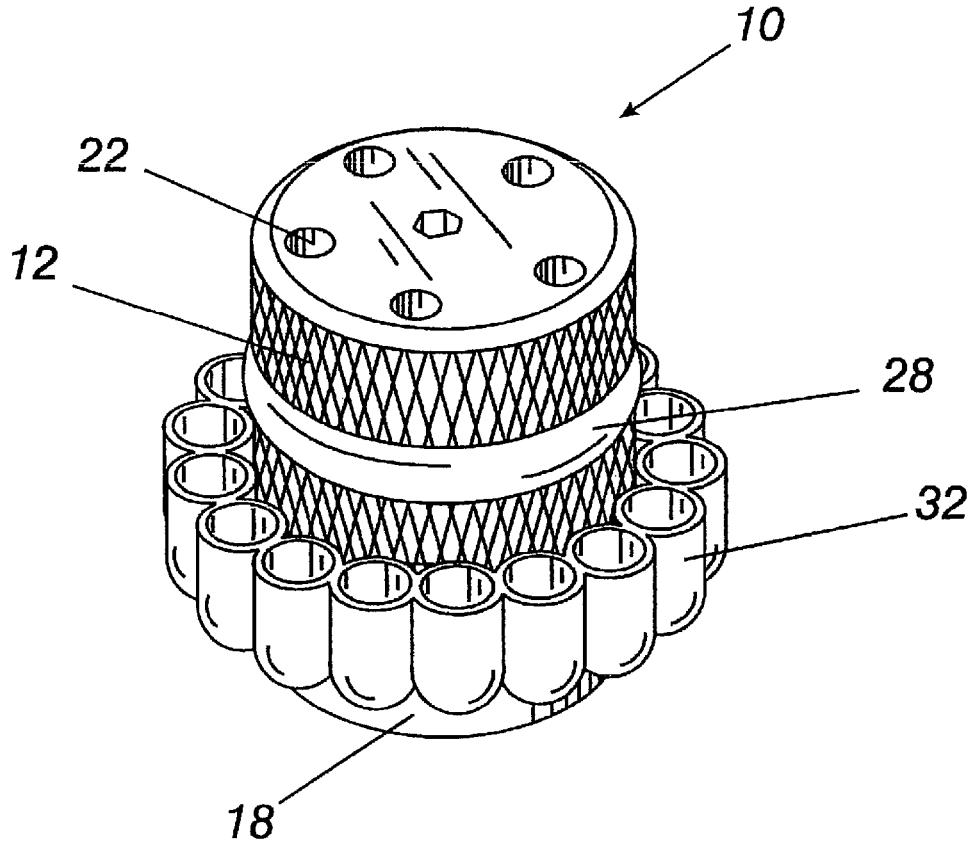
FIG. 9 is a perspective view of the bit holder with an attachment member.

As shown in FIG. 8, a second recessed groove (not shown) may be added that circumvents the exterior of the base 12, preferably below the first recessed groove. A second retention member 30 is positioned within the groove. The purpose of the second retention member 30 is to support various attachment mechanisms that may be added to the bit holder 10, forming a single, solitary unit. One such attachment mechanism 32 is shown in FIG. 9, but a number of various other attachment mechanisms 32 may be substituted or added to the bit holder 10. The attachment mechanism 32, as illustrated in FIG. 9, comprises an internal retention member engaged to a plurality of individual, compartmentalized bit holders. The purpose of the attachment mechanism 32 is to allow the user to store a number of bits on the bit holder 10 for easy transport and use.

In an alternative embodiment, the inner portion of the second recessed groove may intersect the bit compartments 22, forming a bore therebetween (not shown). Similar to FIG. 5, when the bits are inserted into the bit compartments, an outer portion of the bit protrudes into the groove. The second retention member 34 is positioned within the groove, and provides a tension force upon the bit, retaining the bit within the bit compartment 22 until it is removed. In addition to the tension force exerted by the retention member, the optional magnetic member 18 may exert a magnetic force to also retain the bits within the bit compartments.

Figure 10:
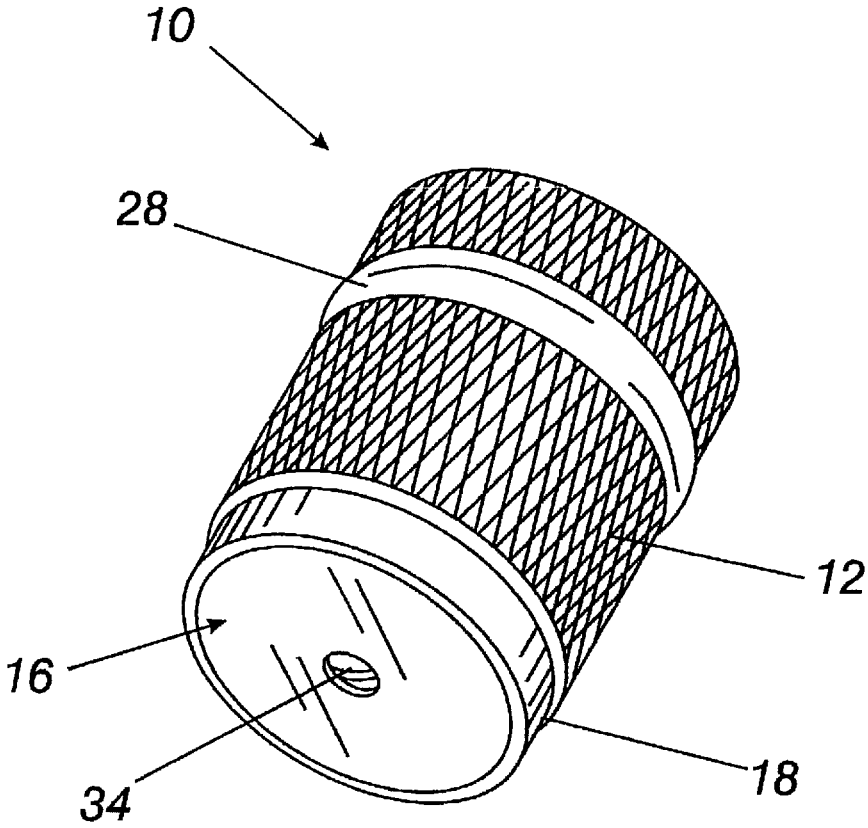
FIG. 10 is a perspective view of the bit holder with a removably attached magnetic member.

In yet another alternative embodiment, the magnetic member 18 is removably attached to the bottom portion 16 of the base 12, as shown in FIG. 10. Preferably, the magnetic member 18 has a threaded bore located within the center of the magnetic member 18, and a corresponding threaded bore is located within the center of the bottom portion 16 of the base 12. A screw 36 removably attaches the magnetic member 18 to the base 12 by utilizing the threaded bores, resulting in a magnetic member 18 that may be removed from the base 12 when the application so desires. Even though a screw is illustrated, the magnetic member 18 and base 12 may be attached by other means, such as a threaded bolt and nut combination or the like.

Figure 11:
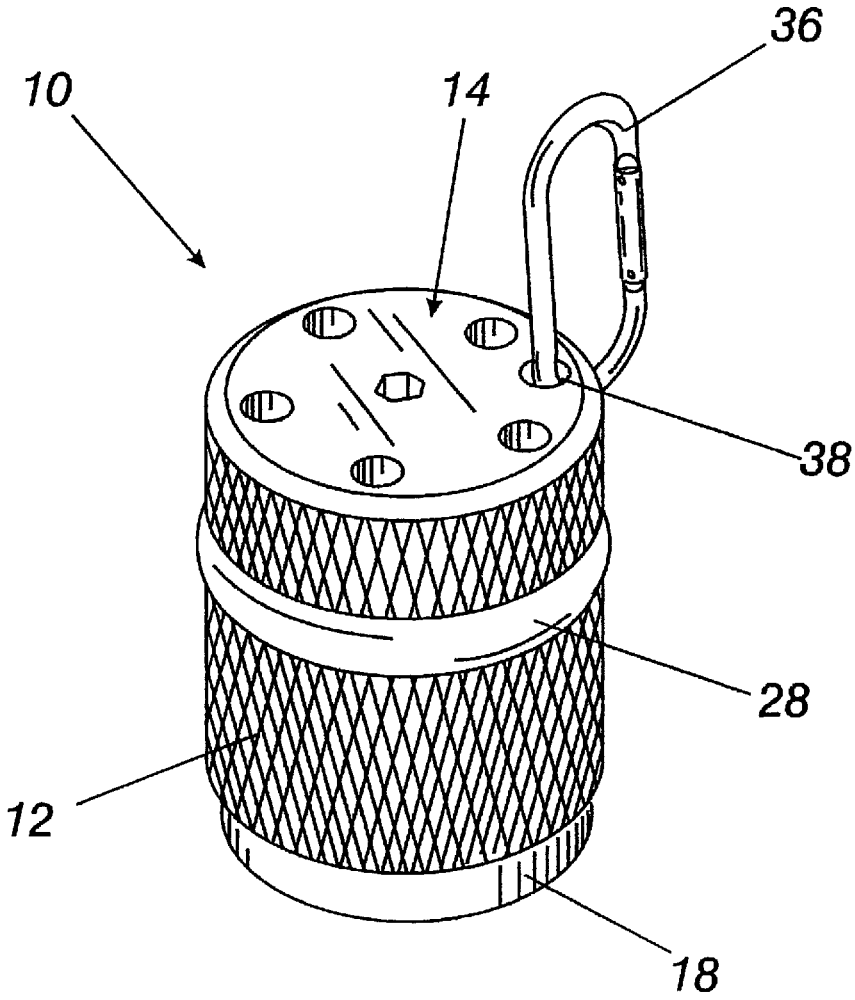
FIG. 11 is a perspective view of the bit holder with a carabiner attached thereto.
Figure 12:
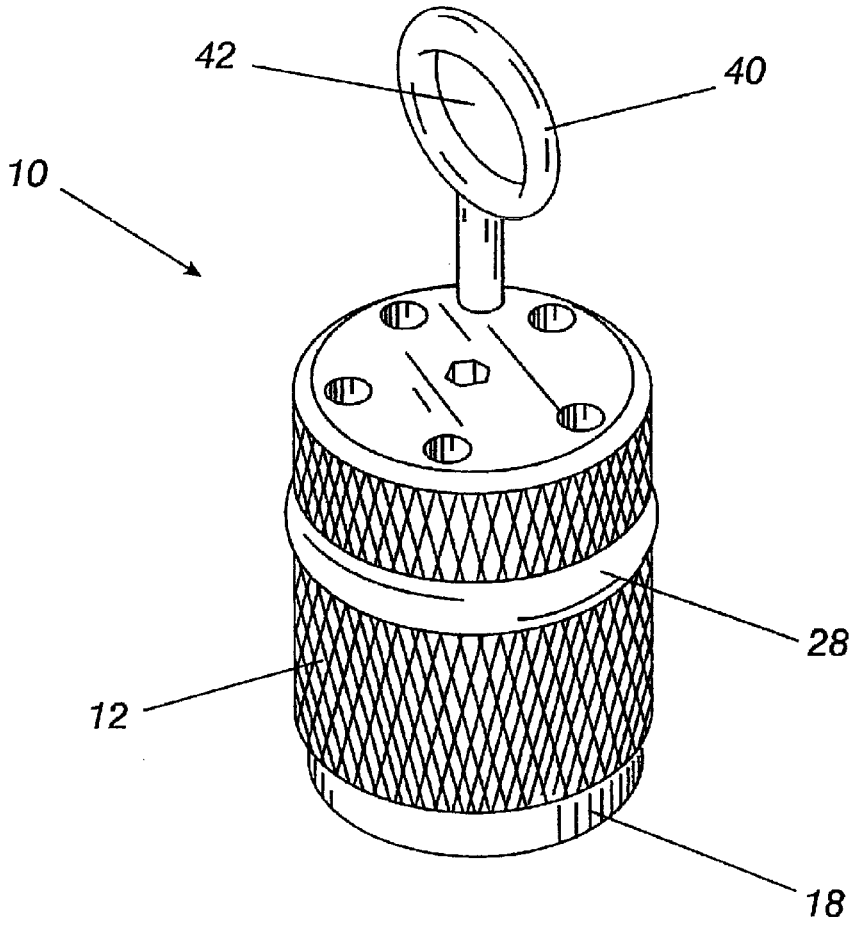
FIG. 12 is a perspective view of the bit holder with an upright attached.

In yet another embodiment, the bit holder 10 may utilize a clip 36, such as a carabiner, as illustrated in FIG. 11. In this particular embodiment, the base includes a clip bore 38 that is formed in the top portion 18 through a side of the base 12. The clip 36 is inserted through the clip bore 38 for attaching the base 12 to the clip 34. The clip 36 may be attached to any portion of the base 12, but by way of illustration, the carabiner, illustrated in FIG. 11, is attached to the top portion 18 of the base 12. The clip 36 may be placed on a belt loop, tool box handle, or a similar commonly attached object (not shown). The clip 36 is designed to allow the bit holder 10 to easily detach from the attached object prior to use.

In yet another embodiment, the bit holder 10 includes an upright 40 extending from the exterior of the bit holder 10. The upright 40 has a hole 42 within the upright for attaching the bit holder to an object, such as, but not limited to, a belt, carabiner or the like. A key ring (not shown) or similar retention object may be inserted through the hole 42 in the upright 40.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A bit holder, comprising:

a base having a plurality of longitudinally oriented bit compartments for releasably storing multiple tool bits;

a recessed groove that circumvents the exterior of the base, wherein the recessed grove intersects each longitudinally oriented bit compartment, forming a bore therebetween, resulting in the tool bit protruding into the groove;

a retention member positioned within the groove for releasably retaining the tool bits within the base.

2. The bit holder of claim 1, further comprising a magnetic member engaged with the base for allowing the base to be removably attached to a metal surface for storage.

3. The bit holder of claim 1, further comprising a second retaining member position on the outside of the base for securing an attachment member.

4. The bit holder of claim 1, further comprising spaced-apart longitudinally oriented bit compartments positioned around the top of the base.

5. The bit holder of claim 1, further comprising a hexagonally shaped bit compartment positioned within the center of the base for accepting a correspondingly shaped bit.

6. The bit holder of claim 1, further comprising the exterior of the base having an abrasive surface for increasing the coefficient of friction and enabling the bit holder to be easily held by a user.

7. The bit holder of claim 1, further comprising a clip for removably attaching the bit holder to an object.

8. The bit holder of claim 1, further comprising an upright for attaching an attachment mechanism thereto.

9. A bit holder, comprising:

a base having a plurality of longitudinally oriented bit compartments for releasably storing multiple tool bits and an outer surface, wherein the outer surface of the base is abrasive for allowing a user to easily grip the base during use;

a recessed groove that circumvents the exterior of the base, wherein the recessed grove intersects each longitudinally oriented bit compartment, forming a bore therebetween, resulting in the tool bit protruding into the recessed groove, a retention member positioned within the recessed groove that exerts a tension force upon the portion of the tool bit protruding into the recessed groove for releasably retaining the tool bits within the base; and a magnetic member engaged with the base for allowing the base to be removably attached to a metal storage surface for storage.

10. The bit holder of claim 9, further comprising a second retaining member position on the outside of the base for securing an attachment member.

11. The bit holder of claim 9, further comprising spaced-apart longitudinally oriented bit compartments positioned around the peripherary of the base.

12. The bit holder of claim 9, further comprising a hexagonally shaped bit compartment positioned within the center of the base for accepting a correspondingly shaped bit.

13. The bit holder of claim 9, further comprising the exterior of the base having a rough surface for increasing the coefficient of friction and enabling the bit holder to be easily held by a user.

14. A bit holder, comprising:

a cylindrical base having a top portion and a bottom portion with a plurality of spaced-apart, longitudinally oriented bit compartments extending from the top portion and recessed into the base for releasably storing multiple tool bits;

an attachment mechanism for storing tool bits that are not retained within the cylindrical base;

a first recessed groove that circumvents the exterior of the base, wherein the recessed groove intersects each longitudinally oriented bit compartment, forming a bore therebetween, resulting in the tool bit protruding into the recessed groove;

a first retention member positioned within the first recessed groove that exerts a tension force upon the portion of the tool bit protruding into the recessed groove for releasably retaining the tool bits within the base;

a second recessed groove that circumvents the exterior of the base, wherein the groove intersects each longitudinally oriented bit compartment, forming a bore therebetween, resulting in each tool bit protruding into the recessed groove;

a second retention member positioned within the second recessed groove that exerts a tension force upon the portion of the tool bit protruding into the recessed groove for releasably retaining the tool bit within the base; and a magnetic member positioned on the bottom portion of the base for allowing the base to be removably attached to a metal storage surface for storage.

15. The bit holder of claim 14, further comprising six equally spaced-apart longitudinally oriented bit compartments positioned around the top portion of the base.

16. The bit holder of claim 14, further comprising a hexagonally shaped bit compartment positioned within the center of the base for accepting a correspondingly shaped bit.

17. A bit holder of claim 14, wherein the magnet is removably attached to the bottom portion of the bit holder.

18. A bit holder of claim 14, wherein the longitudinally oriented bit compartments have a circular cross section receiving correspondingly shaped bits.

19. A bit holder of claim 14, further comprising a clip for removably attaching the bit holder to an object.

* * * * *